US007303664B2

(12) United States Patent
Siskin et al.

(10) Patent No.: US 7,303,664 B2
(45) Date of Patent: Dec. 4, 2007

(54) DELAYED COKING PROCESS FOR PRODUCING FREE-FLOWING COKE USING A METALS-CONTAINING ADDITIVE

(75) Inventors: Michael Siskin, Randolph, NJ (US); Christopher P. Eppig, Vienna, VA (US); Martin L. Gorbaty, Westfield, NJ (US); Leo D. Brown, Baton Rouge, LA (US); Simon R. Kelemen, Annandale, NJ (US); David T. Ferrughelli, Flemington, NJ (US); Fritz A. Bernatz, Houston, TX (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 258 days.

(21) Appl. No.: 10/846,034

(22) Filed: May 14, 2004

(65) Prior Publication Data

US 2004/0262198 A1 Dec. 30, 2004

Related U.S. Application Data

(60) Provisional application No. 60/471,324, filed on May 16, 2003.

(51) Int. Cl.
*C10G 9/14* (2006.01)

(52) U.S. Cl. ..... 208/131

(58) Field of Classification Search ..... 208/131
See application file for complete search history.

(56) References Cited

U.S. PATENT DOCUMENTS

| | | | | |
|---|---|---|---|---|
| 3,558,474 | A | 1/1971 | Gleim et al. | 208/108 |
| 3,617,514 | A | 11/1971 | Marlar | 208/131 |
| 3,684,697 | A | 8/1972 | Gamson | 208/131 |
| 3,707,459 | A | 12/1972 | Mason et al. | 208/76 |
| 3,769,200 | A | 10/1973 | Folkins | 208/53 |
| 3,852,047 | A | 12/1974 | Schlinger et al. | 44/24 |
| 4,096,097 | A * | 6/1978 | Yan | 252/510 |
| 4,140,623 | A | 2/1979 | Sooter et al. | 208/131 |
| 4,298,455 | A | 11/1981 | Huang | 208/48 AA |
| 4,399,024 | A | 8/1983 | Fukui et al. | 208/131 |
| 4,411,770 | A | 10/1983 | Chen et al. | 208/111 |
| 4,430,197 | A | 2/1984 | Poynor et al. | 208/56 |
| 4,440,625 | A | 4/1984 | Go et al. | 208/48 AA |
| 4,455,219 | A | 6/1984 | Janssen et al. | 208/131 |
| 4,518,487 | A | 5/1985 | Graf et al. | 208/131 |
| 4,529,501 | A | 7/1985 | George | 208/127 |
| 4,549,934 | A | 10/1985 | Graf et al. | 196/98 |
| 4,592,830 | A | 6/1986 | Howell et al. | 208/94 |
| 4,612,109 | A | 9/1986 | Dillon et al. | 208/131 |
| 4,616,308 | A | 10/1986 | Morshedi et al. | 364/159 |
| 4,659,453 | A | 4/1987 | Kukes et al. | 208/108 |
| 4,713,168 | A * | 12/1987 | Newman | 208/131 |
| 4,927,561 | A | 5/1990 | Forester | 252/389.22 |
| 5,160,602 | A | 11/1992 | Becraft et al. | 208/131 |
| 5,248,410 | A | 9/1993 | Clausen et al. | 208/131 |
| 5,258,115 | A | 11/1993 | Heck et al. | 208/131 |
| 5,460,714 | A | 10/1995 | Fixari et al. | 208/112 |
| 5,645,711 | A | 7/1997 | Hraban et al. | 208/131 |
| 5,820,750 | A | 10/1998 | Blum et al. | 208/263 |
| 5,853,565 | A | 12/1998 | Cayton | 208/48 AA |
| 6,048,904 | A | 4/2000 | Wiehe et al. | 516/20 |
| 6,168,709 | B1 | 1/2001 | Etter | 208/131 |
| 6,193,875 | B1 | 2/2001 | Pereira et al. | 208/130 |
| 6,264,829 | B1 | 7/2001 | Antalffy et al. | 208/131 |
| 6,387,840 | B1 | 5/2002 | Salazar et al. | 502/170 |
| 6,611,735 | B1 | 8/2003 | Henly et al. | 700/266 |
| 6,660,131 | B2 | 12/2003 | Lah | 202/245 |
| 2002/0033265 | A1 | 3/2002 | Varadaraj | 166/303 |
| 2002/0125174 | A1 | 9/2002 | Varadaraj | 208/263 |
| 2002/0161059 | A1 | 10/2002 | Varadaraj et al. | 516/113 |
| 2003/0127314 | A1 | 7/2003 | Bell et al. | 202/262 |
| 2003/0132139 | A1 | 7/2003 | Varadaraj | 208/265 |
| 2003/0191194 | A1 | 10/2003 | Varadaraj | 516/52 |
| 2004/0035749 | A1 | 2/2004 | Khan et al. | 208/106 |

FOREIGN PATENT DOCUMENTS

| | | |
|---|---|---|
| EP | 0031697 | 7/1981 |
| EP | 175511 | 6/1988 |
| GB | 1218117 | 1/1971 |
| WO | 95/14069 | 5/1995 |
| WO | 99/64540 | 12/1999 |
| WO | 03042330 | 5/2003 |
| WO | 03048271 | 6/2003 |
| WO | 2004/038316 | 5/2004 |
| WO | 2004/104139 | 12/2004 |

OTHER PUBLICATIONS

"Applied artificial intelligence for delayed coking," J. J. Kelley, Foster Wheeler USA Corp., Houston, TX, reprinted from Hydrocarbon Processing magazine, Nov. 2000 issue, pp. 144-A to 144-J.

"Tutorial: Delayed Coking Fundamentals," Ellis, Paul J., Paul, Christopher A. Great Lakes Carbon Corporation, Port Arthur, TX. copyright 1998 (unpublished). Presented at the AIChE 1998 Spring National Meeting, New Orleans, LA, Mar. 8-12, 1998.

(Continued)

*Primary Examiner*—Glenn Caldarola
*Assistant Examiner*—John Douglas
(74) *Attorney, Agent, or Firm*—Gerald J. Hughes; W. Robinson H. Clark

(57) ABSTRACT

A delayed coking process for making substantially free-flowing coke, preferably shot coke. A coker feedstock, such as a vacuum residuum, is heated in a heating zone to coking temperatures then conducted to a coking zone wherein volatiles are collected overhead and coke is formed. A metals-containing additive is added to the feedstock prior to it being heated in the heating zone, prior to its being conducted to the coking zone, or both.

13 Claims, 5 Drawing Sheets

OTHER PUBLICATIONS

"The effect of carbon additives on the mesophase induction period of Athabasca bitumen," Gentzis, Thomas; Rahimi, Parviz; Malhotra, Ripudaman; Hirschon, Albert S. Fuel Processing Technology 69 (2001) 191-203.

"Upgrading of petroleum residue with dispersed additives," Dabkowski, M.J.; Shih, S.S.; Albinson, K.R., Mobil Research & Development Corporation, Paulsboro, NJ. Presented as Paper 19E, at the 1990 AIChE National Meeting.

Giavarini, C.; Mastrofini, D.; Scrsella, M., "Macrostructure and Rheological Properties of Chemically Modified Residues and Bitumens," Energy & Fuels 2000, 14, pp. 495-502.

Lakatos-Szabo, J.; Lakatos, I., "Effect of sodium hydroxide on interfacial rheological properties of oil-water systems," Research Institute of Applied chemistry, University of Miskolc, Hungary, accepted Aug. 24, 1998, Elsevier Science B.V., Physicochemical and Engineering Aspects 149 (1999), pp. 507-513.

* cited by examiner

DELAYED COKING PROCESS FOR PRODUCING FREE-FLOWING COKE USING A METALS-CONTAINING ADDITIVE

CROSS-REFERENCE TO RELATED APPLICATION

This application claims benefit of U.S. Provisional Patent Application Ser. No. 60/471,324 filed May 16, 2003.

FIELD OF THE INVENTION

The present invention relates to a delayed coking process for making substantially free-flowing coke, preferably shot coke. A coker feedstock, such as a vacuum residuum, is heated in a heating zone to coking temperatures then conducted to a coking zone wherein volatiles are collected overhead and coke is formed. A metals-containing additive is added to the feedstock prior to it being heated in the heating zone, prior to its being conducted to the coking zone, or both.

DESCRIPTION OF RELATED ART

Delayed coking involves thermal decomposition of petroleum residua (resids) to produce gas, liquid streams of various boiling ranges, and coke. Delayed coking of resids from heavy and heavy sour (high sulfur) crude oils is carried out primarily as a means of disposing of these low value feedstocks by converting part of the resids to more valuable liquid and gaseous products. Although the resulting coke is generally thought of as a low value by-product, it may have some value, depending on its grade, as a fuel (fuel grade coke), electrodes for aluminum manufacture (anode grade coke), etc.

In the delayed coking process, the feedstock is rapidly heated in a fired heater or tubular furnace. The heated feedstock is then passed to a coking drum that is maintained at conditions under which coking occurs, generally at temperatures above about 400° C. under super-atmospheric pressures. The heated residuum feed in the coker drum also forms volatile components that are removed overhead and passed to a fractionator, leaving coke behind. When the coker drum is full of coke, the heated feed is switched to another drum and hydrocarbon vapors are purged from the coke drum with steam. The drum is then quenched with water to lower the temperature to less than about 100° C. after which the water is drained. When the cooling and draining steps are complete, the drum is opened and the coke is removed after drilling and/or cutting using high velocity water jets.

For Example, a hole is typically bored through the center of the coke bed using water jet nozzles located on a boring tool. Nozzles oriented horizontally on the head of a cutting tool then cut the coke from the drum. The coke removal step adds considerably to the throughput time of the overall process. Thus, it would be desirable to be able to produce a free-flowing coke, in a coker drum, that would not require the expense and time associated with conventional coke removal.

Even though the coker drum may appear to be completely cooled, areas of the drum do not completely cool. This phenomenon, sometimes referred to as "hot drum", may be the result of a combination of morphologies of coke being present in the drum, which may contain a combination of more than one type of solid coke product, i.e., needle coke, sponge coke and shot coke. Since unagglomerated shot coke may cool faster than other coke morphologies, such as large shot coke masses or sponge coke, it would be desirable to produce predominantly substantially free flowing shot coke in a delayed coker, in order to avoid or minimize hot drums.

SUMMARY OF THE INVENTION

In an embodiment, there is provided a delayed coking process comprising:

(a) heating a petroleum resid in a first heating zone, to a temperature below coking temperatures but to a temperature wherein the resid is a pumpable liquid;

(b) conducting said heated resid to a second heating zone wherein it is heated to coking temperatures;

(c) conducting said heated resid from said second heating zone to a coking zone wherein vapor products are collected overhead and a coke product is formed;

(d) introducing into said resid at least metals-containing additive that is effective for the formation of substantially free-flowing coke, wherein said metals-containing additive is introduced into said resid at a point upstream of the second heating zone, upstream of said coking zone, or both.

In a preferred embodiment, the coking zone is in a delayed coker drum, and a substantially free-flowing shot coke product is formed.

In another embodiment, there is provided a delayed coking process comprising:

a) contacting a vacuum resid with an effective amount of at least one metals-containing additive at a temperature from about 70° C. to about 370° C. for a time sufficient to disperse the agent uniformly into the feed;

b) heating the treated resid to a temperature effective for coking said feed;

c) charging said heated treated resid to a coking zone at a pressure from about 15 to 80 psig for a coking time to form a bed of hot coke; and d) quenching at least a portion of the bed of hot coke with water.

In another embodiment a substantially free-flowing shot coke product is formed and removed from the coking zone. The coking zone is preferably a delayed coker drum. The additive can be incorporated and combined with the feed either before the feed is introduced into the heating zone, which is a coker furnace, or it can be introduced into the feed between the coker furnace and coker drum. It is also within the scope of this invention that the additive be introduced into the feed in both locations. The same additive, or additives, can be added independently at each location or a different additive or additives can be added at each location.

Use of the term "combine" and "contact" are meant in their broad sense. i.e. that in some cases physical and/or chemical changes in the additive and/or the feed can occur in the additive, the feed, or both when additive is present in the feed. In other words, the invention is not restricted to cases where the additive and/or feed undergo no chemical and/or physical change following or in the course of the contacting and/or combining. An "effective amount" of additive is the amount of additive(s) that when contacted with the feed would result in the formation of shot coke in the coking zones, preferably substantially free-flowing shot coke. An effective amount typically ranges from about 100 to about 100,000 ppm (based on the total weight of the metal in the additive and feed), but would depend on the species of additive and its chemical and physical form. While not wishing to be bound by any theory or model, it is believed that the effective amount is less for additives species in a physical and chemical form that lead to better dispersion in the feed than for additive species that are more difficult to disperse. This is why additives that are at least partially soluble in organics, more preferably in the resid feed, are most preferred.

The additive can be selected from organic soluble compounds, organic insoluble compounds, or non-organic dispersible compounds. The least preferred additives are those that result in an undesirable amount of foaming. In an embodiment, the additive is an organic soluble metal compound, such as a metal naphthenate or a metal acetylacetonate, and mixtures thereof. Preferred metals are potassium, sodium, iron, nickel, vanadium, tin, molybdenum, manganese, cobalt, calcium, magnesium and mixtures thereof. Additives in the form of species naturally present in refinery streams can be used. For such additives, the refinery stream may act as a solvent for the additive, which may assist in dispersing the additive in the resid feed. Non-limiting examples of additives naturally present in refinery streams include nickel, vanadium, iron, sodium, and mixtures thereof naturally present in certain resid and resid fractions (i.e., certain feed streams), e.g., as porphyrins, naphthenates, etc. The contacting of the additive and the feed can be accomplished by blending a feed fraction containing additive species (including feed fractions that naturally contain such species) into the feed.

In another embodiment, the additive is a Lewis acid. Preferred Lewis acids include ferric chloride, zinc chloride, titanium tetrachloride, aluminum chloride, and the like.

In another embodiment, the metals-containing additive is a finely ground solid having a high surface area, a natural material of high surface area, or a fine particle/seed producing additive. Such high surface area materials include alumina, catalytic cracker fines, FLEXICOKER cyclone fines, magnesium sulfate, calcium sulfate, diatomaceous earth, clays, magnesium silicate, vanadium-containing fly ash and the like. The additives may be used either alone or in combination.

Preferably, a caustic species is added to the resid coker feedstock. When used, the caustic species may be added before, during, or after heating in the coker furnace. Addition of caustic will reduce the Total Acid Number (TAN) of the resid coker feedstock and also convert naphthenic acids to metal naphthenates, e.g., sodium naphthenate.

Uniform dispersal of the additive into the resid feed is desirable to avoid heterogeneous areas of coke morphology formation. That is, one does not want locations in the coke drum where the coke is substantially free flowing and other areas where the coke is substantially non-free flowing. Dispersing of the additive is accomplished by any number of ways, preferably by introducing a side stream of the additive into the feedstream at the desired location. The additive can be added by solubilization of the additive into the resid feed, or by reducing the viscosity of the resid prior to mixing in the additive, e.g., by heating, solvent addition, etc. High energy mixing or use of static mixing devices may be employed to assist in dispersal of the additive agent, especially additive agents that have relatively low solubility in the feedstream Preferably, all or substantially all of the coke formed in the process is substantially free-flowing coke, more preferably, substantially free-flowing shot coke. It is also preferred that at least a portion of volatile species present in the coker drum during and after coking be separated and conducted away from the process, preferably overhead of the coker drum.

Figure 1:
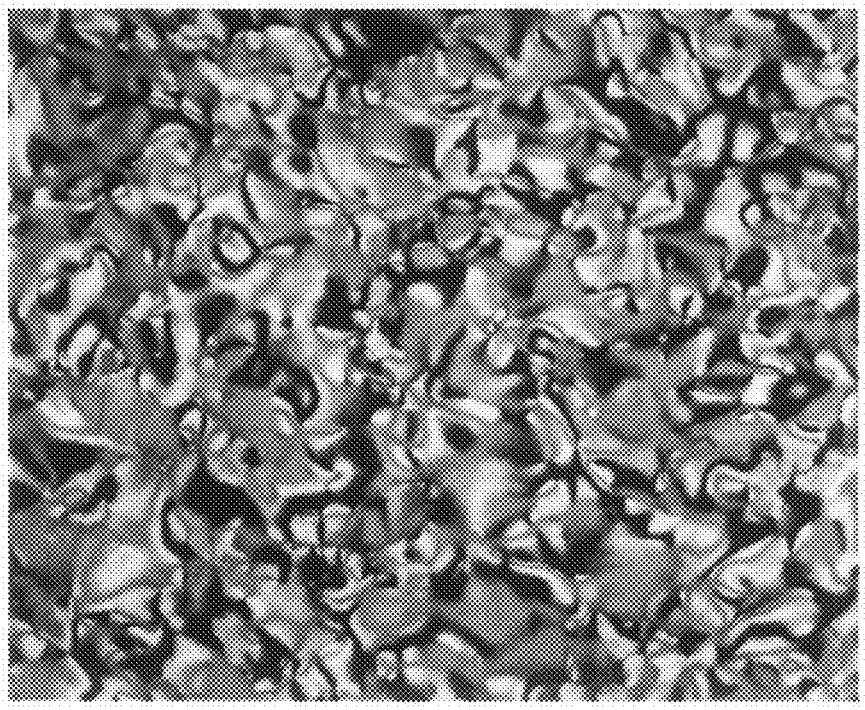
FIG. 1 is an optical micrograph showing coke formed from a sponge coke making resid feed (Mid West Rocky Mountain) that contained no additive. The figure shows flow domains ranging in size from about 10 to about 35 micrometers (typical of sponge coke), and a coarse mosaic ranging from about 5 to about 10 micrometers (typical of shot coke).

All photomicrographs in these Figures used cross-polarized light, with a viewing area of 170 by 136 micrometers.

DETAILED DESCRIPTION OF THE INVENTION

Petroleum vacuum residua ("resid") feedstocks are suitable for delayed coking. Such petroleum residua are frequently obtained after removal of distillates from crude feedstocks under vacuum and are characterized as being comprised of components of large molecular size and weight, generally containing: (a) asphaltenes and other high molecular weight aromatic structures that would inhibit the rate of hydrotreating/hydrocracking and cause catalyst deactivation; (b) metal contaminants occurring naturally in the crude or resulting from prior treatment of the crude, which contaminants would tend to deactivate hydrotreating/hydrocracking catalysts and interfere with catalyst regeneration; and (c) a relatively high content of sulfur and nitrogen compounds that give rise to objectionable quantities of $SO_2$, $SO_3$, and $NO_X$ upon combustion of the petroleum residuum. Nitrogen compounds present in the resid also have a tendency to deactivate catalytic cracking catalysts.

In an embodiment, resid feedstocks include but are not limited to residues from the atmospheric and vacuum distillation of petroleum crudes or the atmospheric or vacuum distillation of heavy oils, visbroken resids, tars from deasphalting units or combinations of these materials. Atmospheric and vacuum topped heavy bitumens can also be employed. Typically, such feedstocks are high-boiling hydrocarbonaceous materials having a nominal initial boiling point of about 538° C. or higher, an API gravity of about 20° or less, and a Conradson Carbon Residue content of about 0 to 40 weight percent.

The resid feed is subjected to delayed coking. Generally, in delayed coking, a residue fraction, such as a petroleum residuum feedstock is pumped to a heater at a pressure of about 50 to 550 psig, where it is heated to a temperature from about 480° C. to about 520° C. It is then discharged into a coking zone, typically a vertically-oriented, insulated coker drum through an inlet at the base of the drum. Pressure in the drum is usually relatively low, such as about 15 to 80 psig to allow volatiles to be removed overhead. Typical operating temperatures of the drum will be between about 410° C. and 475° C. The hot feedstock thermally cracks over a period of time (the "coking time") in the coker drum, liberating volatiles composed primarily of hydrocarbon products, that continuously rise through the coke mass and are collected overhead. The volatile products are sent to a coker fractionator for distillation and recovery of coker gases, gasoline, light gas oil, and heavy gas oil. In an embodiment, a portion of the heavy coker gas oil present in the product stream introduced into the coker fractionator can be captured for recycle and combined with the fresh feed (coker feed component), thereby forming the coker heater or coker furnace charge. In addition to the volatile products, delayed coking also forms solid coke product.

There are generally three different types of solid delayed coker products that have different values, appearances and properties, i.e., needle coke, sponge coke, and shot coke. Needle coke is the highest quality of the three varieties. Needle coke, upon further thermal treatment, has high electrical conductivity (and a low coefficient of thermal expansion) and is used in electric arc steel production. It is relatively low in sulfur and metals and is frequently produced from some of the higher quality coker feedstocks that include more aromatic feedstocks such as slurry and decant oils from catalytic crackers and thermal cracking tars. Typically, it is not formed by delayed coking of resid feeds.

Sponge coke, a lower quality coke, is most often formed in refineries. Low quality refinery coker feedstocks having significant amounts of asphaltenes, heteroatoms and metals produce this lower quality coke. If the sulfur and metals content is low enough, sponge coke can be used for the manufacture of electrodes for the aluminum industry. If the sulfur and metals content is too high, then the coke can be used as fuel. The name "sponge coke" comes from its porous, sponge-like appearance. Conventional delayed coking processes, using the preferred vacuum resid feedstock of the present invention, will typically produce sponge coke, which is produced as an agglomerated mass that needs an extensive removal process including drilling and water-jet technology. As discussed, this considerably complicates the process by increasing the cycle time.

Shot coke is considered the lowest quality coke. The term "shot coke" comes from its shape which is similar to that of BB sized (about 1/16 inch to 3/8 inch) balls. Shot coke, like the other types of coke, has a tendency to agglomerate, especially in admixture with sponge coke, into larger masses, sometimes larger than a foot in diameter. This can cause refinery equipment and processing problems. Shot coke is usually made from the lowest quality high resin-asphaltene feeds and makes a good high sulfur fuel source, particularly for use in cement kilns and steel manufacture. There is also another coke, which is referred to as "transition coke" and refers to a coke having a morphology between that of sponge coke and shot coke or composed of mixture of shot coke bonded to sponge coke. For example, coke that has a mostly sponge-like physical appearance, but with evidence of small shot spheres beginning to form as discrete shapes.

It has been discovered that substantially free-flowing shot coke can be produced by treating the residuum feedstock with one or more metal-containing additives of the present invention. The additives are those that enhance the production of shot coke during delayed coking. A resid feed is subjected to treatment with one or more additives, at effective temperatures, i.e., at temperatures that will encourage the additives' dispersal in the feed stock. Such temperatures will typically be from about 70° C. to about 500° C., preferably from about 150° C. to about 370° C., more preferably from about 185° C. to about 350° C. The additive suitable for use herein can be liquid or solid form, with liquid form being preferred. Non-limiting examples of additives that can be used in the practice of the present invention include metal hydroxides, naphthenates and/or carboxylates, metal acetylacetonates, Lewis acids, a metal sulfide, metal acetate, metal carbonate, high surface area metal-containing solids, inorganic oxides and salts of oxides. Salts that are basic are preferred It is to be understood that before or after the resid is treated with the additive, a caustic species, preferably in aqueous form, may optionally be added. The caustic can be added before, during, or after the resid is passed to the coker furnace and heated to coking temperatures. Spent caustic obtained from hydrocarbon processing can be used. Such spent caustic can contain dissolved hydrocarbons, and salts of organic acids, e.g., carboxylic acids, phenols, naphthenic acids and the like.

Figure 2:
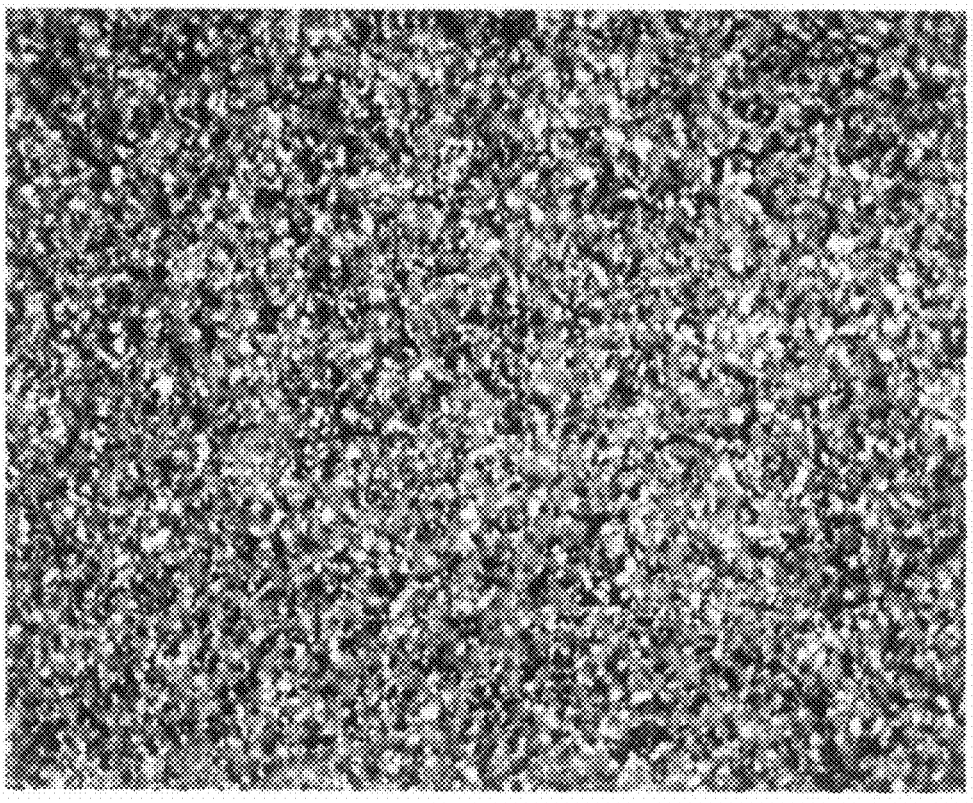
FIG. 2 shows the effect of vanadium (as vanadyl naphthenate) on coke morphology. The figure is an optical micrograph showing coke formed from a resid feed containing 500 ppm (0.05 wt. %) vanadium in the form of vanadyl naphthenate. The figure shows a very fine mosaic compared to FIG. 1, in the range of about 0.5 to 3 micrometers (typical of shot coke).
Figure 3:
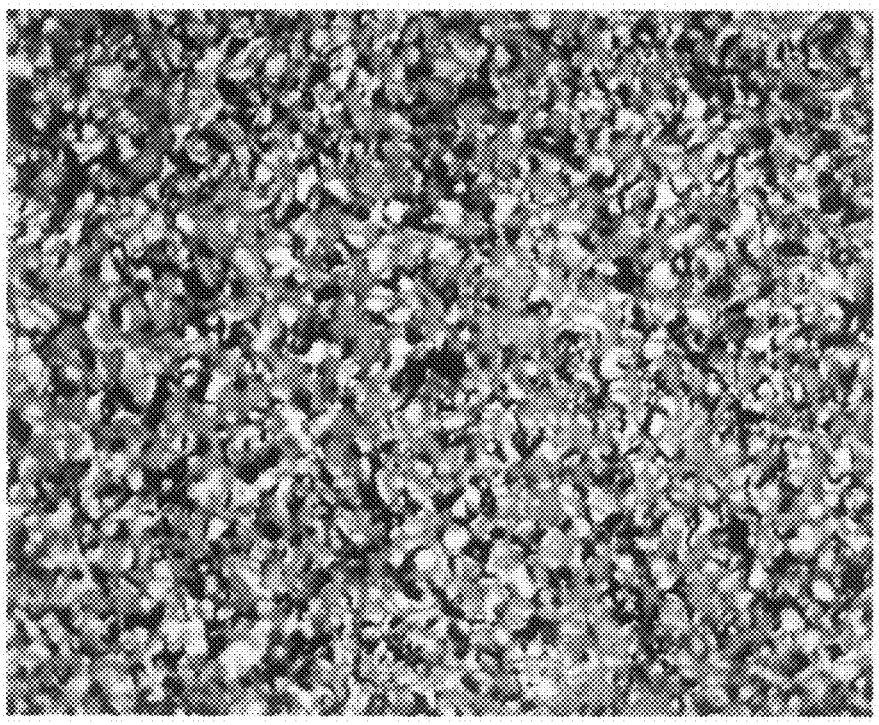
FIG. 3 shows the effect of sodium (as sodium naphthenate) on coke morphology. The figure is an optical micrograph showing coke formed from a resid feed containing 500 ppm (0.05 wt. %) sodium in the form of sodium naphthenate. The figure shows a fine mosaic compared to FIG. 1, in the range of about 1.5 to 6 micrometers.
Figure 4:
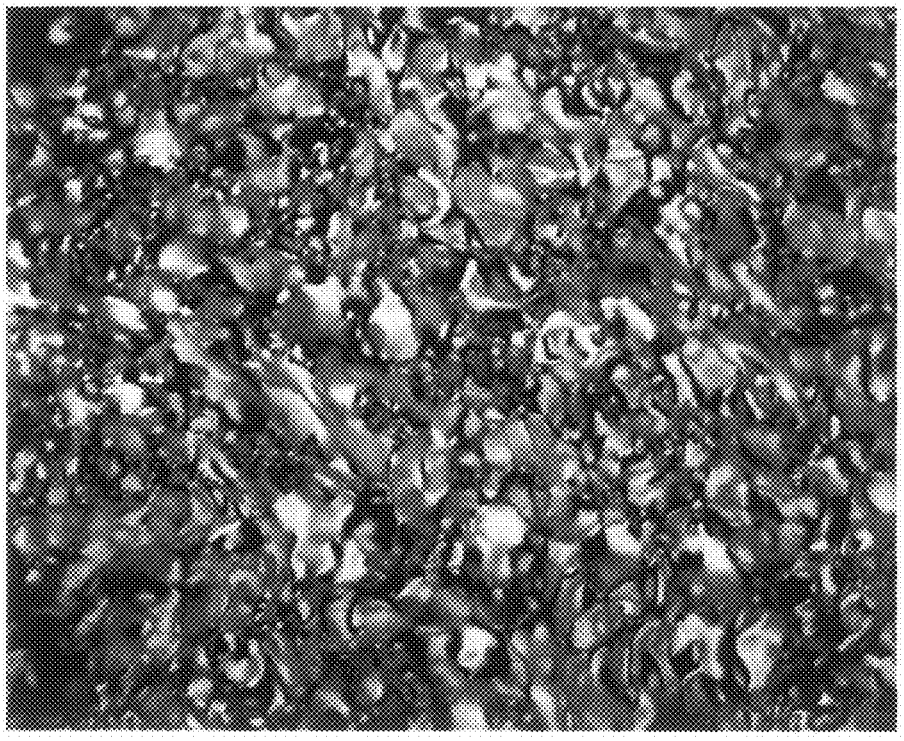
FIG. 4 is an optical micrograph showing coke formed from a transition coke making resid feed (Joliet Heavy Canadian) that contained no additive. The figure shows flow domains ranging in size from about 10 to about 35 micrometers (typical of sponge coke), and a coarse mosaic ranging from about 5 to about 10 micrometers (typical of shot coke).
Figure 5:
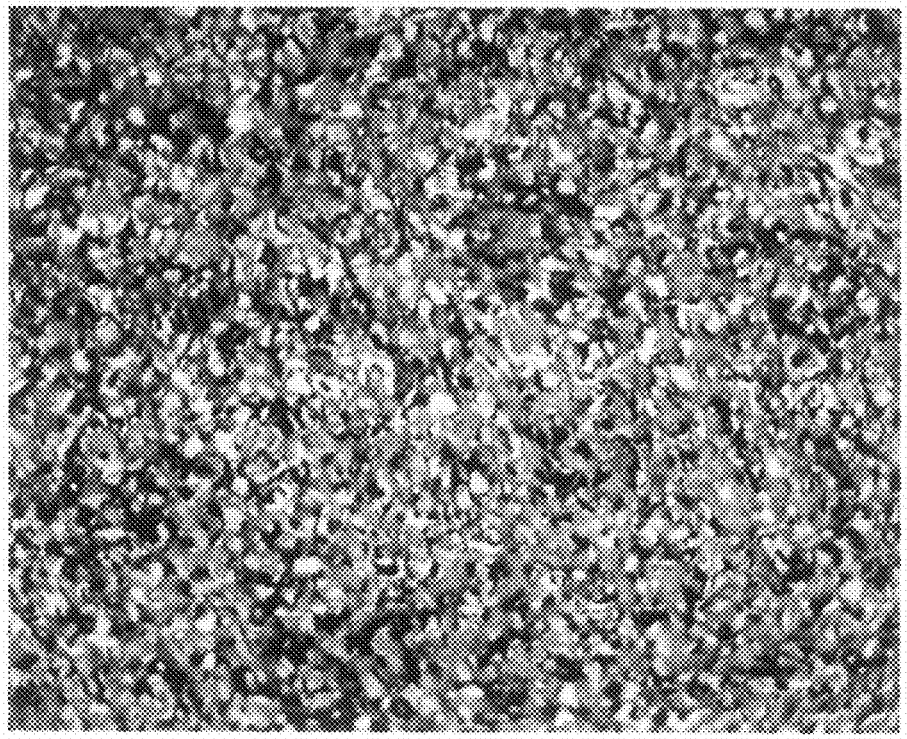
FIG. 5 shows the effect of calcium on coke morphology of the transition coke making feed. The figure is an optical micrograph showing coke formed from a resid feed containing 250 wppm (0.025 wt. %) calcium in the form of calcium hydroxide. The figure shows a fine mosaic compared to FIG. 4, in the range of about 1.5 to 6 micrometers.

The precise conditions at which the resid feedstock is treated with the additive is feed and additive dependent. That is, the conditions at which the feed is treated with the additive are dependent on the composition and properties of the feed to be coked and the additive used. These conditions can be determined conventionally. For example, several runs would be made with a particular feed containing an additive at different times and temperatures followed by coking in a bench-scale reactor such as a Microcarbon Residue Test Unit (MCRTU). The resulting coke is then analyzed by use of an optical and/or polarized light microscopy as set forth herein. The preferred coke morphology (i.e., one that will produce substantially free-flowing coke) is a coke microstructure of discrete micro-domains having an average size of about 0.5 to 10 μm, preferably from about 1 to 5 μm, somewhat like the mosaic shown in FIGS. 2, 3 and 5 hereof. Coke microstructure that represents coke that is not free-flowing shot coke is shown in FIG. 1 hereof, showing a coke microstructure that is composed substantially of non-discrete, or substantially large flow domains up to about 60 μm or greater in size, typically from about 10 to 60 μm.

Conventional coke processing aids, including an anti-foaming agent, can be employed in the process of the present invention wherein a resid feedstock is air blown to a target softening point as described in U.S. Pat. No. 3,960,704. While shot coke has been produced by conventional methods, it is typically agglomerated to such a degree that water-jet technology is still needed for its removal.

In one embodiment of the present invention, the resid feedstock is first treated with an additive that encourages the formation of substantially free-flowing coke. By keeping the coker drum at relatively low pressures, much of the evolving volatiles can be collected overhead, which prevents undesirable agglomeration of the resulting shot coke. The combined feed ratio ("CFR") is the volumetric ratio of furnace charge (fresh feed plus recycle oil) to fresh feed to the continuous delayed coker operation. Delayed coking operations typically employ recycles of about 5 vol. % to 25% (CFRs of about 1.05 to 1.25). In some instances there is 0 recycle and sometimes in special applications recycle up to 200%. CFRs should be low to aid in free flowing shot coke formation, and preferably no recycle should be used.

While not wishing to be bound to any specific theory or model, the additive or mixture of additives employed are believed to function via one or more of the following pathways: a) as dehydrogenation and cross-linking agents when metals present in the feed are converted into metal sulfides that are catalysts for dehydrogenation and shot coke formation; b) agents that add metal-containing species into the feed that influence or direct the formation of shot coke or are converted to species, e.g., metal sulfides, that are catalysts for shot coke formation; c) as particles that influence the formation of shot coke by acting as microscopic seed particles for the shot coke to be formed around, as Lewis acid cracking and cross-linking catalysts, and the like. Additives may also alter or build viscosity of the plastic mass of reacting components so that shear forces in the coker furnace, transfer line and coke drum roll the plastic mass into small spheres. Even though different additives and mixtures of additives may be employed, similar methods can be used for contacting the additive(s) with the feed.

Typically, additive(s) are conducted to the coking process in a continuous mode. If needed, the additive could be dissolved or slurried into an appropriate transfer fluid, which will typically be solvent that is compatible with the resid and in which the additive is substantially soluble. The fluid mixture or slurry is then pumped into the coking process at a rate to achieve the desired concentration of additives in the feed. The introduction point of the additive can be, for example, at the discharge of the furnace feed charge pumps, or near the exit of the coker transfer line. There can be a pair of mixing vessels operated in a fashion such that there is continuous introduction of the additives into the coking process.

The rate of additive introduction can be adjusted according to the nature of the resid feed to the coker. Feeds that are on the threshold of producing shot coke may require less additive than those which are farther away from the threshold.

For additives that are difficult to dissolve or disperse in resid feeds, the additive(s) are transferred into the mixing/slurry vessel and mixed with a slurry medium that is compatible with the feed. Non-limiting examples of suitable slurry mediums include coker heavy gas oil, water, etc. Energy may be provided into the vessel, e.g., through a mixer for dispersing the additive.

For additives which can be more readily dissolved or dispersed in resid feeds, the additive(s) are transferred into the mixing vessel and mixed with a fluid transfer medium that is compatible with the feed. Non-limiting examples of suitable fluid transfer mediums include warm resid (temp. between about 150° C. to about 300° C.), coker heavy gas oil, light cycle oil, heavy reformate, and mixtures thereof. Cat slurry oil (CSO) may also be used also, though under some conditions it may inhibit the additives' ability to produce loose shot coke. Energy may provided into the vessel, e.g., through a mixer, for dispersing the additive into the fluid transfer medium.

The present invention will be better understood by reference to the following non-limiting examples that are presented for illustrative purposes.

EXAMPLES

General Procedures for Addition of Additives into Vacuum Resid Feeds

The resid feed is heated to about 70-150° C. to decrease its viscosity. The additive (in weight parts per million, wppm) is then added slowly, with mixing, for a time sufficient to disperse and/or solubilize the additive(s) (a "dispersing time"). For laboratory experiments, it is generally preferred to first dissolve and/or disperse the additive in a solvent, e.g., toluene, tetrahydrofuran, or water, and blend it with stirring into the heated resid, or into the resid to which some solvent has been added to reduce its viscosity. The solvent can then be removed. In a refinery, the additive contacts the resid when it is added to or combined with the resid feed. As discussed, the contacting of the additive and the feed can be accomplished by blending a feed fraction containing additive species (including feed fractions that naturally contain such species) into the feed. Additives in the form of organometallic compound(s) are generally soluble in the vacuum resids. To assure maximum dispersion of the additive into the vacuum resid feed, the reaction mixture can be heat soaked. In one example, the appropriate amount of metal acetylacetonate (acac) was dissolved in tetrahydrofuran (THF) under an inert atmosphere, then added to a round bottom flask containing the residuum in which it was to be dispersed. The THF/oil mixture was allowed to stir for 1 hr. at 50° C. to distribute the metal substantially uniformly throughout the resid. The THF was then removed by roto-evaporation to leave the metal acetylacetonate well dispersed in the residuum. A sample of the mixture was analyzed for metals to verify the concentration of metal in the oil was at the target value.

The following tests were conducted using various additives to a resid feed. Additive concentration, heat soak time, and the resulting coke morphology as determined from optical micrographs are set forth in Tables 1-7 below. Control samples of resid with no additive was used by way of comparison.

TABLE 1

EFFECT OF METAL ADDITIVE AGENTS ON MORPHOLOGY OF MCR COKE ON A SPONGE COKE-FORMING VACUUM RESID

| Additive | Concentration (wppm) | Heat Soak at 370° C. (min) | MCR Domain/ Mosaic-Domain Size/Comments (μm) |
|---|---|---|---|
| None | 0 | 30 | 5-30 - Sponge coke |
| Vanadyl Naphthenate | 1,000 | None | 0.5-3 μm very fine to fine mosaic. Shot coke |
| Vanadium Naphthenate | 2,500 | 30 | 0.5-1 μm very fine mosaic - shot coke |
| Vanadium Sulfide | 2,500 | 30 | 5-30 with localized 1-3 μm where VxSy exists |
| Nickel Naphthenate | 1,000 | None | 1-5 μm fine mosaic - Shot coke |

TABLE 1-continued

EFFECT OF METAL ADDITIVE AGENTS ON MORPHOLOGY OF MCR COKE ON A SPONGE COKE-FORMING VACUUM RESID

| Additive | Concentration (wppm) | Heat Soak at 370° C. (min) | MCR Domain/ Mosaic-Domain Size/Comments (μm) |
|---|---|---|---|
| Nickel Naphthenate | 2,500 | None | 0.5-3 μm very fine to fine mosaic. Shot coke |
| Sodium Naphthenate | 2,500 | None | 0.5-4 μm very fine to fine mosaic. Shot coke |
| Iron Chloride | 2,500 | 30 | 5-25 with localized 1-3 μm where sulfide exists - Illustrates effect of heterogeneity |
| Iron Acetyl-acetonate | 10,000 | 30 | 0.5-3 μm very fine mosaic. Shot coke |
| Vanadyl Acetyl-acetonate | 10,000 | 30 | <0.5 μm ultra fine mosaic. Shot coke |
| Vanadyl Acetyl-acetonate | 1,000 | 30 | 0.5-2 μm very fine mosaic. Shot coke |
| Nickel Acetyl-acetonate | 10,000 | 30 | 0.5-2 μm very fine mosaic. Shot coke |
| Nickel Acetyl-acetonate | 1,000 | 30 | 1-4 μm fine/medium mosaic. Shot coke |
| Mixture of Nickel and Vanadyl Acetyl-acetonates | 5,000 ppm Ni 5,000 ppm V | 30 | <0.5-0.7 μm ultra fine mosaic. Shot coke |
| Mixture of Iron and Vanadyl acetyl-acetonates | 5,000 ppm Fe 5,000 ppm V | 30 | <0.5-1 μm very fine mosaic. Shot Coke |
| Mixture of Iron and Nickel acetyl-acetonates | 5,000 ppm Fe, 5,000 ppm Ni | 30 | 0.5-3 μm fine mosaic. Shot coke. |

TABLE 2

EFFECT OF METAL ADDITIVE AGENTS ON MORPHOLOGY OF MCR COKE ON A SPONGE COKE-FORMING VACUUM RESID

| Sample No. | Additive | Additive (wppm) | MCR (wt %) | Microscopy on MCR Coke: Domain/Mosaic Size (μm) | Coke Type |
|---|---|---|---|---|---|
| Oil Soluble Additives | | | | | |
| 100-1 | None | — | 14.43, 15.45, 14.40, 14.50 | Flow domains (10-35 μm) & coarse mosaic (5-10 μm) | Sponge |
| 113-11 | Vanadyl Naphthenate[1] | 2500 | 13.46 | Extra fine mosaic (0.5-1.5 μm) | Shot |
| 113-1 | Vanadyl Naphthenate | 1000 | 14.22 | Very fine mosaic (0.5-2 μm) | Shot |
| 121-3 | Vanadyl Naphthenate | 500 | 15.31 | Very fine mosaic (0.5-3 μm) | Shot |
| 126-4 | Vanadyl Naphthenate | 300 | 15.38 | Fine/Medium mosaic (1-5 μm) | Shot |
| 113-14 | Sodium Naphthenate | 2500 | 12.50 | Very fine mosaic (0.5-3 μm) | Shot |
| 113-4 | Sodium Naphthenate | 1000 | 12.20 | Fine/medium mosaic (1-4 μm) | Shot |
| 121-4 | Sodium Naphthenate | 500 | 13.17 | Fine/Medium mosaic (1.5-6 μm) | Shot |
| 125-5 | Sodium Naphthenate | 300 | 14.29 | Medium/Coarse mosaic (2-10 μm) | Shot |
| 113-13 | Nickel Naphthenate | 2500 | 14.36 | Very fine mosaic (0.5-3 μm) | Shot |
| 113-3 | Nickel Naphthenate | 1000 | 13.71 | Fine/medium mosaic (1-4 μm) | Shot |
| 127-3 | Sodium Cresylate | 1000 | 13.37 | Fine/medium mosaic (1-4 μm) | Shot |
| 127-2 | Sodium Cresylate | 500 | 12.68 | Coarse mosaic/domains (3-15 μm) with localized regions 0.5-4 μm. | Transition |
| 131-5 | Sodium Cresylate on Heavy Canadian Transition Coke-former[3] | 430[2] | 19.90 | Fine mosaic (0.5-3 μm) | Shot |
| 118-6 | Vanadyl Acetyl-acetonate[2] | 3000 | 18.05 | — | Shot |
| 142-2 | Vanadyl Acetyl-acetonate[2] | 1000 | 16.90 | Very fine mosaic (0.5-2.5 μm) | Shot |
| 142-1 | Nickel Acetyl-acetonate[2] | 1000 | 16.51 | Very fine/fine mosaic (0.5-4 μm) | Shot |
| 118-13 | Vanadyl tetraphenylporphine | 1000 | 17.05 | Extra fine mosaic (<0.5-1 μm) | Shot |
| 118-10 | Nickel tetraphenylporphine | 1000 | 17.93 | Very fine mosaic (0.5-3 μm) | Shot |

[1]The naphthenate additives, dissolved in 3-5 mL of toluene were added slowly to the stirring vacuum resid at 100-125° C. Stirring was continued for 30 min and the toluene solvent was evaporated under a nitrogen flow to the tare weight of the resid plus additive.
[2]Acac's were THF solubilized and added into the vacuum resid at 40° C. THF was removed under vacuum at 40-60° C.
[3]Supplemented by 250 ppm V and 106 ppm Ni naturally occurring in this resid

TABLE 3

EFFECT OF METAL ADDITIVE AGENTS ON MORPHOLOGY OF MCR COKE ON A SPONGE COKE-FORMING VACUUM RESID

| Sample No. | Additive | Additive (wppm) | MCR (wt %) | Microscopy on MCR Coke: Domain/Mosaic Size (μm) | Coke Type |
|---|---|---|---|---|---|
| Blender as Aqueous solution | | | | | |
| 136-1 | Sodium Chloride | 1000 | 14.1 | Flow Domains (10-20 μm) with isolated areas of fine/medium mosaic (1-5 μm) | Sponge |
| 136-2 | Sodium Sulfate | 1000 | 15.7 | Flow Domains (10-20 μm) with isolated areas of fine/medium mosaic (1-4 μm) | Transition |
| 136-3 | Sodium Sulfide | 1000 | 15.2 | Fine/Medium mosaic (0.5-3 μm) | Shot |
| 136-4 | Sodium Acetate | 1000 | 13.4 | Fine/Medium mosaic (1-5 μm) | Shot |
| 136-5 | Ferric Chloride | 1000 | 13.0 | Flow Domains (10-20 μm) with isolated areas of fine/medium mosaic (1-5 μm) | Transition |
| 136-6 | Zinc Chloride | 1000 | 14.1 | Flow Domains (10-20 μm) with isolated areas of fine/medium mosaic (1-5 μm) | Sponge/ some Transition |
| 136-7 | Sodium Hydroxide | 1000 | 14.4 | Fine/Medium mosaic (0.5-4 μm) | Shot |
| 136-9 | Potassium Hydroxide | 1000 | 13.6 | Very Fine mosaic (0.5-2.5 μm) | Shot |
| 136-10 | Lithium Hydroxide | 1000 | 12.6 | Fine/Medium mosaic (0.5-5 μm) with extensive regions of coarse mosaic (5-10 μm) | Transition |

The required amount of Additive agent dissolved in 20 mL of water at 80° C. was slowly added to the vacuum resid in a blender at 100-125° C. The mixture was blended until homogeneous. Water was evaporated under a nitrogen flow while raising the temperature of the mixture to 150° C.

TABLE 4

EFFECT OF METAL ADDITIVE AGENTS ON MORPHOLOGY OF MCR COKE ON A SPONGE COKE-FORMING VACUUM RESID

| Sample No. | Additive | Additive (wppm) | MCR (wt %) | Microscopy on MCR Coke: Domain/Mosaic Size (μm) | Coke Type |
|---|---|---|---|---|---|
| Blender as Slurry[1] | | | | | |
| 137-1 | Vanadium Pentoxide | 1000 | 14.2 | Flow Domains (10-20 μm) and medium/coarse mosaic (3-10 μm) | Sponge |
| 137-2 | FLEXICOKER Fines | 1000 - V | 20.3 | Coarse mosaic (5-10 μm) with areas of fine/medium mosaic (1-5 μm) | Transition |
| 137-5 | Tin Powder | 1000 | 13.8 | Flow Domains (10-25 μm) with coarse mosaic (5-10 μm) | Sponge |
| 137-6 | Zinc Powder | 1000 | 16.1 | Domains (10-25 μm) and coarse mosaic (5-10 μm). Isolated areas of fine/medium mosaic (1-5 μm). | Sponge/ Transition |
| 140-10 | Cesium Hydroxide | 1000 | 14.3 | Medium/Coarse mosaic (2-10 μm); ~1/3 molar equiv of Na. | Shot |
| 142-14 | Cesium hydroxide | 3,400 | 15.3 | Very fine mosaic (0.5-2 μm). | |
| 140-8 | Ferric Oxalate hydrate | 1000 | 15.0 | Flow Domains (10-30 μm) and isolated areas of fine/medium mosaic (1-5 μm). | Transition |
| 140-5 | Ferric Acetate | 1000 | 13.5 | Flow Domains (10-30 μm) and isolated areas of fine/medium mosaic (1-5 μm). | Transition |
| 140-6 | Zinc Acetate | 1000 | 13.9 | Flow Domains (10-35 μm) and coarse mosaic (5-10 μm). | Sponge |
| 140-9 | Zinc Oxalate | 1000 | 15.5 | Flow Domains (10-35 μm) and coarse mosaic (5-10 μm). | Sponge |
| 140-7 | Iron Naphthenate | 1000 | 14.1 | Fine/Medium mosaic (1-5 μm) and some coarse mosaic (5-10 μm) | Shot |

[1]Blended as a slurry at 150° C. without solvent

TABLE 5

EFFECT OF METAL ADDITIVE AGENTS ON MORPHOLOGY OF MCR COKE ON A SPONGE COKE-FORMING VACUUM RESID

| Sample No. | Additive | Additive (wppm M) | MCR (wt %) | Microscopy on MCR Coke: Domain/Mosaic Size (μm) | Coke Type |
|---|---|---|---|---|---|
| 142-3 | Fe Acetyl-acetonate | 1000 | 14.8 | Very fine mosaic (1-5 μm), some coarse mosaic (5-10 μm) | Transition |
| 114-2 | Fe Acetyl-acetonate | 1000 | 15.4 | Very fine mosaic (0.5-3 μm) | Shot |
| 22-2 | Ni Acetyl-acetonate + Fe Acetyl-acetonate | 500 + 500 | 15.6 | Very fine mosaic (0.5-3 μm) | Shot |
| 122-1 | V Acetyl-acetonate + Fe Acetyl-acetonate | 500 + 500 | 15.1 | Very fine mosaic (<0.5-1 μm) | Shot |
| 121-1 | Calcium Naphthenate | 1000 | 14.6 | Flow domains (10-25 μm) and coarse mosaic (5-10 μm) | Sponge |
| 121-2 | Calcium Naphthenate | 2500 | 14.1 | Flow domains (10-15 μm) and coarse mosaic (5-10 μm) | Sponge/ Transition |
| 150-2 | Calcium Acetyl-acetonate | 5000 | 14.6 | Small domains (10-15 μm) and medium/coarse mosaic (2-10 μm) | Transition |
| 125-12 | Calcium acetate | 5000 | 15.6 | Coarse mosaic/small domains (5-15 μm) with abundant localized fine domains (0.5-3 μm) | Transition |
| 125-13 | Calcium acetate | 1000 | 14.6 | Coarse mosaic/small domains (5-15 μm) with minor localized fine/medium mosaic (1-4 μm) | Sponge |
| 144-8 | Sodium sulfonate | 500 | 14.4 | Flow domains (10-25 μm) and isolated areas of fine/medium mosaic (1-5 μm) | Transition |
| 144-9 | Calcium sulfonate | 500 | 16.3 | Coarse mosaic domains (5-15 μm) and abundant areas of fine/medium mosaic (1-5 μm) | Transition |
| 146-1 | Sodium hydrosulfide | 1000 | 23.4 | Medium/coarse mosaic (2-10 μm) | Shot |
| 146-2 | Sodium borate | 1000 | 14.9 | Flow domains (10-30 μm) and areas of coarse mosaic (5-10 μm) | Sponge |
| 146-3 | Potassium borate | 1000 | 13.0 | Flow domains (10-30 μm) and areas of coarse mosaic (5-10 μm) | Sponge |
| 146-4 | Ferric sulfate | 1000 | 14.7 | Flow domains (10-30 μm) and areas of coarse mosaic (5-10 μm) | Sponge |
| 146-5 | Ferric acetate | 1000 | 14.5 | Small domains (10-20 μm) and areas of medium/coarse mosaic (2-10 μm) | |
| 146-12 | Zinc Naphthenate | 1000 | 13.24 | Domains/coarse mosaic (10-15 μm) and isolated areas of fine/medium mosaic (1-5 μm) | Sponge |
| 144-11 | Mn porphyrin | 1000 | 15.2 | Medium/coarse mosaic (2-10 μm) and areas of fine/medium mosaic (1-5 μm) | Transition/ Shot |
| 144-10 | Porphine - NO METALS | 3000 | 14.6 | Coarse mosaic domains (5-20 μm) and areas of fine/medium mosaic (1-5 μm) | Transition |

Acac's were THF solubilized and added into the vacuum resid at 40° C. THF was removed under vacuum at 40-60° C. Calcium salts were dissolved in water and blended into the resid at 100-125° C.

TABLE 6

EFFECT OF METAL ADDITIVE AGENTS ON MORPHOLOGY OF MCR COKE OF A TRANSITION COKE-FORMING VACUUM RESID

| Sample No. | Additive | Additive (wppm M) | MCR (wt %) | Microscopy on MCR Coke: Domain/Mosaic Size (μm) | Coke Type |
|---|---|---|---|---|---|
| 144-13 | Heavy Canadian | — | 16.0 | | |
| 142-8 | Sodium hydroxide | 250 | 19.8 | Fine/medium mosaic (0.5-4 μm) | Shot |
| 142-5 | Sodium cresylate | 250 | 19.4 | Fine/medium mosaic (0.5-6 μm) | Shot |
| 142-13 | Sodium sulfonate | 250 | 16.7 | Fine/medium mosaic (1-7 μm) | Shot |
| 142-9 | Potassium hydroxide | 250 | 20.5 | Fine/medium mosaic (0.5-6 μm) | Shot |
| 142-6 | Potassium cresylate | 250 | 16.5 | Fine/medium mosaic (1-7 μm) | Shot |
| 142-10 | Calcium hydroxide | 250 | 20.6 | Fine/medium mosaic (1-7 μm) | Shot |
| 142-12 | Calcium sulfonate | 250 | 19.8 | Medium/coarse mosaic (2-9 μm) | Shot |
| 144-1 | Sodium hydroxide | 500 | 21.4 | Fine/medium mosaic (0.5-3 μm) | Shot |
| 144-2 | Sodium cresylate | 500 | 19.9 | Fine/medium mosaic (0.5-5 μm) | Shot |
| 144-3 | Sodium sulfonate | 500 | 17.6 | Fine/medium mosaic (0.5-6 μm) | Shot |
| 144-4 | Potassium hydroxide | 500 | 19.3 | Fine/medium/coarse mosaic (1-10 μm) | Shot |
| 144-5 | Potassium cresylate | 500 | 20.8 | Fine/medium mosaic (1-6 μm) | Shot |
| 144-6 | Calcium hydroxide | 500 | 20.8 | Fine/medium mosaic (1-6 μm) | Shot |
| 144-7 | Calcium sulfonate | 500 | 19.3 | Fine/medium mosaic (1-7 μm) | Shot |

Dissolved in water, heated to 80° C. and blended into resid at 100-125° C. in a blender.

TABLE 7

MISCELLANEOUS

| Sample No. | Additive | Additive (wppm M) | MCR (wt %) | Microscopy on MCR Coke: Domain/Mosaic Size (μm) | Coke Type |
|---|---|---|---|---|---|
| 140-1 | 75% Maya: 25% CHAD | | 22.4 | Fine/Medium mosaic (1-7 μm) | Shot |
| 142-2 | CHAD + sodium acetate | 1,000 | 13.6 | Fine/Medium mosaic (1-6 μm) | Shot Coke |
| 142-3 | CHAD + iron naphthenate | 1,000 | 11.3 | Fine/Medium mosaic (1-7 μm) | Shot Coke |
| 146-6 | Heavy Canadian + sodium acetate | 250 | 21.4 | Fine/medium mosaic (0.5-5 μm) | Shot |
| 146-7 | Heavy Canadian + potassium acetate | 250 | 18.2 | Medium/Coarse mosaic (1-8 μm) | Shot |
| 146-8 | Off-Shore Marlim | — | 18.2 | Flow domains (10-60 μm) | Sponge |
| 146-9 | Off-Shore Marlim + NaOH | 500 | 17.5 | Domain/coarse (5-20 μm) and isolated areas of fine/medium mosaic (1-5 μm) | Transition |
| 146-10 | Off-Shore Marlim + NaOH | 1000 | 17.9 | Medium/coarse mosaic (1-8 μm) and isolated areas of fine/medium mosaic (0.5-3 μm) | Shot |

*NHI = n-heptane insolubles (asphaltenes)

The Heavy Canadian feed used in the examples herein contained 250 wppm V, 106 wppm Ni, 28 wppm Na, and 25 wppm Fe.

The Maya feed contained 746 wppm V, 121 wppm Ni, 18 wppm Na, and 11 wppm Fe.

The Off-Shore Marlim feed contained 68 wppm V, 63 wppm Ni, 32 wppm Na, and 25 wppm Fe.

The Chad feed contained 0.7 wppm V, 26 wppm Na, 31 wppm Ni, and 280 wppm Fe.

Polarizing light microscopy was used in these examples for comparing and contrasting structures of green coke (i.e., non-calcined coke) samples.

At the macroscopic scale, i.e., at a scale that is readily evident to the naked eye, petroleum sponge and shot green cokes are quite different—sponge has a porous sponge-like appearance, and shot coke has a spherical cluster appearance. However, under magnification with an optical microscope, or polarized-light optical microscope, additional differences between different green coke samples may be seen, and these are dependent upon amount of magnification.

For example, utilizing a polarized light microscope, at a low resolution where 10 micrometer features are discernable, sponge coke appears highly anisotropic, the center of a typical shot coke sphere appears much less anisotropic and the surface of a shot coke sphere appears fairly anisotropic.

At higher resolutions, e.g., where 0.5 micrometer features are discernable (this is near the limit of resolution of optical microscopy), a green sponge coke sample still appears highly anisotropic. The center of a shot coke sphere at this resolution is now revealed to have some anisotropy, but the anisotropy is much less than that seen in the sponge coke sample.

It should be noted that the optical anisotropy discussed herein is not the same as "thermal anisotropy", a term known to those skilled in the art of coking. Thermal anisotropy refers to coke bulk thermal properties such as coefficient of thermal expansion, which is typically measured on cokes which have been calcined, and fabricated into electrodes.

Microcarbon residue (MCR) tests were performed on the above feeds to generate cokes to be evaluated by optical microscopy. MCR techniques are described in J. B. Green, et al., Energy Fuels, 1992, 6, 836-844. The following is the procedure used for the MCR tests:

| Heating Profile | Time (min) | $N_2$ Flow (cc/min) |
|---|---|---|
| Heat from room temp to 100° C. | 10 | 66 |
| Heat from 100° C. to 300° C. then to 500° C. | 30 | 66/19.5 |
| Hold at 500° C. | 15 | 19.5 |
| Cool to room temp | 40 | 19.5 |

FIG. 1 is a cross-polarized light photomicrograph showing the microstructure of the resulting coke from an untreated resid feed. The viewing area for both is 170 microns by 136 microns. The untreated residuum resulted in a coke with a microstructure that was not discrete fine domains. The domains were relatively large (10-35 μm) flow domains. This indicates that sponge coke will be produced in the coker drum of a delayed coker. The microstructure of FIG. 2, in which the vacuum residuum sample was treated with 2500 ppm of vanadium as soluble vanadyl naphthenate, shows a dramatic reduction in flow domain size to relatively fine (0.5-1 μm) discrete fine domains indicating that free-flowing shot coke will be produced in the coker drum of a delayed coker.

The invention claimed is:

1. A delayed coking process comprising:

(a) heating a petroleum resid in a first heating zone, to a temperature below coking temperatures but to a temperature wherein the resid is a pumpable liquid;

(b) conducting the heated resid to a second heating zone wherein it is heated to coking temperatures;

(c) conducting said heated resid from said second heating zone to a coking zone operating at a temperature between about 410° C. and 475° C. wherein vapor products are collected overhead and a coke product is formed;

(d) introducing into said resid at least one metals-containing additive in an amount ranging from 100 to 3000 wppm (based on the total weight of the metal in the additive to the weight of the resid feed) where said metals-containing additive is effective for the formation of substantially free-flowing shot coke, and wherein said metals-containing additive is introduced into said resid at a point upstream of the second heating zone, upstream of said coking zone, or both; and (e) removing a substantially free-flowing shot coke from the coking zone comprising discrete micro-domains having an average size of about 0.5 to 10 μm.

2. The process of claim 1 wherein the resid feedstock is vacuum resid.

3. The process of claim 2 wherein at least a portion of the additive is soluble in the feedstock.

4. The process of claim 3 wherein the metals-containing additive is selected from the metal napthenates and metal acetylacetonates wherein the metal is selected from the group consisting of vanadium, nickel, iron, tin, molybdenum, cobalt and sodium.

5. The process of claim 1 where the metals-containing additive is one or more Lewis acids selected from the group consisting of aluminum chloride, zinc chloride, iron chloride, titanium tetrachloride and boron trifluoride.

6. The process of claim 1 where the metals-containing additive is a high surface area material selected from the group consisting of alumina, catalytic cracker fines, magnesium sulfate, calcium sulfate, diatomaceous earth, clays, magnesium silicate, vanadium-containing fly ash, and mixtures thereof.

7. The process of claim 1 further comprising adding caustic to the resid feed.

8. The process of claim 1 wherein said metals-containing additive is introduced into vacuum resid at a point upstream of the first heating zone, upstream of the second heating zone, or both.

9. A delayed coking process comprising:

a) contacting a vacuum resid with of at least one metals-containing additive selected from metal naptenates, metal acetylacetonates, metal cresylates, metal sulfides, metal sulfonates, metal hydrosulfides, metal actates, potassium hydroxide, calcium hydroxide and a mixture thereof, in an amount ranging from 100 to 3000 wppm (based on the total weight of the metal in the additive to the weight of the feed), that is effective for the formation of a substantially free-flowing shot coke, at a temperature from about 70° C. to about 370 C. for a time sufficient to disperse the agent uniformly into the feed;

b) heating the treated resid to a temperature effective for coking said feed;

c) charging said heated treated resid to a coking zone at a pressure from about 15 to 80 psig and a temperature between about 410°C. and 475°C. (for a sufficient time to form a bed of hot coke;

d) quenching at least a portion of the bed of hot coke with water; and e) removing a substantially free-flowing shot coke from the coking zone comprising discrete micro-domains having an average size of about 0.5 to 10 μm.

10. The process of claim 9 wherein at least a portion of the additive is soluble in the resid feedstock.

11. The process of claim 10 wherein the metals-cnotaining additive is selected from the metal napthenares and metal acctylacetonates wherein the metal is selected from the group consisting of vanadium, nickel, iron, tin, molybdenum, cobalt, and sodium.

12. The process of claim 9 further comprising adding caustic to the resid feed.

13. The process of claim 1 wherein the metals-containing additive is selected from (i) metal naptenates, (ii) metal acetylacetonates, (iii) metal hydroxides, (iv) metal cresylates, (v) metal sulfides, (vi) metal sulfonates, (vii) metal hydrosulfides, (viii) metal acetates, (ix) metal carbonates and (x) mixtures thereof.

* * * * *